US012312054B2

(12) United States Patent
O'Rourke et al.

(10) Patent No.: US 12,312,054 B2
(45) Date of Patent: May 27, 2025

(54) TRANSITION RAILS FOR SHIPLIFT TRANSFER SYSTEMS

(71) Applicant: Bardex Corporation, Goleta, CA (US)

(72) Inventors: Charlie O'Rourke, Ventura, CA (US); Daniel Lyons, Lompoc, CA (US)

(73) Assignee: Bardex Corporation, Goleta, CA (US)

( * ) Notice: Subject to any disclaimer, the term of this patent is extended or adjusted under 35 U.S.C. 154(b) by 201 days.

(21) Appl. No.: 18/151,814

(22) Filed: Jan. 9, 2023

(65) Prior Publication Data

US 2023/0219666 A1 Jul. 13, 2023

Related U.S. Application Data

(60) Provisional application No. 63/297,341, filed on Jan. 7, 2022.

(51) Int. Cl.

| | |
|---|---|
| ***B63C 3/08*** | (2006.01) |
| ***B61B 13/02*** | (2006.01) |
| ***B63C 3/02*** | (2006.01) |
| ***B63C 3/06*** | (2006.01) |

(52) U.S. Cl.

CPC ..... *B63C 3/08* (2013.01); *B61B 13/02* (2013.01); *B63C 3/02* (2013.01); *B63C 3/06* (2013.01)

(58) Field of Classification Search

CPC .. B63C 3/08; B63C 3/02; B63C 15/00; B63C 3/06; E02C 3/00; B61B 13/02

See application file for complete search history.

(56) References Cited

U.S. PATENT DOCUMENTS

| | | | | |
|---|---|---|---|---|
| 6,082,931 | A | 7/2000 | Hopper | |
| 10,577,061 | B2 | 3/2020 | Taylor | |
| 11,383,804 | B2 | 7/2022 | Taylor et al. | |
| 11,390,364 | B2 | 7/2022 | Taylor et al. | |
| 2010/0189502 | A1 | 7/2010 | Basta et al. | |
| 2010/0196097 | A1 | 8/2010 | Lee | |
| 2016/0288888 | A1* | 10/2016 | Peterson | B63C 3/06 |
| 2017/0197694 | A1 | 7/2017 | Choi et al. | |
| 2020/0370263 | A1 | 11/2020 | Wang et al. | |
| 2021/0016861 | A1* | 1/2021 | Peterson | E02C 3/00 |
| 2021/0114694 | A1* | 4/2021 | Henson | B63B 27/36 |

OTHER PUBLICATIONS

International Search Report and Written Opinion received in PCT Application PCT/US23/60307 issued on Apr. 24, 2023. [11 pages].
International Preliminary Report on Patentability received in PCT Application PCT/US23/60307 issued on Jul. 18, 2024. [7 pages].

* cited by examiner

*Primary Examiner* — Carib A Oquendo
(74) *Attorney, Agent, or Firm* — Michael S. McCoy; Amatong McCoy LLC

(57) ABSTRACT

A shiplift transfer system for moving a ship between a shiplift platform and a shipyard is disclosed. The system includes transition rails coupled with the shipyard that are pivotable about trunnion pins between a position that bridges a gap between the shipyard and the shiplift platform and a position that is clear of the gap and of the shiplift platform. The pins are positioned such that the load is not transferred to the pins. Load on the transition rails is reacted at curved surfaces of the transition rails that are engaged with curved surfaces on the yard. The transition rails are accessible for maintenance and replacement via removable plates. The rails include beveling to accommodate misalignment between the yard and platform.

37 Claims, 10 Drawing Sheets

TRANSITION RAILS FOR SHIPLIFT TRANSFER SYSTEMS

CROSS-REFERENCE TO RELATED APPLICATIONS

The present application claims the benefit of U.S. Provisional Patent Application No. 63/297,341, filed on Jan. 7, 2022 (pending), and entitled "Transition Rails for Shiplift Transfer Systems," the entirety of which is incorporated herein by reference.

FIELD

The present disclosure relates to transition rails for shiplift transfer systems, to systems including the same, and to methods of making and using the same.

BACKGROUND

Shiplift transfer involves the movement of a ship onto and off a shiplift platform. Typically, a ship is dry docked and launched using a shiplift, which includes a shiplift platform that is lifted and lowered relative to the dock by hoists. Bogies are then used to transfer the ships off of the shiplift platform and onto the shipyard. Bogies are also used to transfer ships off of the shipyard and onto the shiplift platform. Various issues may arise when moving a ship from a shiplift platform to a shipyard or when moving a ship from a shipyard to a shiplift platform. Such issues often arise due to misalignment between the shiplift platform and shipyard (and associated rails thereon) and to relative movement of the shiplift platform and shipyard (and associated rails thereon).

BRIEF SUMMARY

An embodiment of the present disclosure includes a shiplift transfer system. The system includes a shipyard having a shipyard rail thereon. A shiplift platform is positioned adjacent the shipyard. The shiplift platform has a platform rail thereon. A transition rail is movably coupled with the shipyard and is movable between at least two positions. The at least two positions include a first rail position in which the transition rail extends across a gap between the shipyard and the shiplift platform and is engaged with the shiplift platform, and in which the transition rail is positioned between the shipyard rail and the platform rail. The at least two positions include a second rail position in which the transition rail is disengaged from the shiplift platform.

An embodiment of the present disclosure includes a method of transferring a ship between a shipyard and a shiplift platform. The method includes positioning a shiplift platform adjacent a shipyard. The shipyard has a shipyard rail thereon and the shiplift platform has a platform rail thereon. A gap is between the shipyard and the shiplift platform such that the shipyard rail and the shiplift platform are spaced apart. The method includes positioning a transition rail on the shipyard into a first rail position such that the transition rail extends across the gap and is engaged with the shiplift platform and such that the transition rail is positioned between and aligned with the shipyard rail and the platform rail. The method includes moving a ship supported on a transfer cradle between the shiplift platform and the shipyard. Moving the ship includes moving the transfer cradle with a bogie having a rail wheel. During the moving, the rail wheel rolls along each of the shipyard rail, the transition rail, and the platform rail. After moving the ship, the method includes moving the transition rail into a second rail position such that the transition rail is disengaged from the shiplift platform and is clear of the gap. In the second rail position, the transition rail is spaced apart from the gap. In some embodiments, the transition rail is positioned inward of a perimeter of the shipyard when in the second rail position, and is positioned outward of the perimeter of the shipyard when in the first rail position.

An embodiment of the present disclosure includes a shiplift transfer system. The system includes a shipyard having a shipyard rail thereon and a shiplift platform positioned adjacent the shipyard. The shiplift platform has a platform rail thereon. A transition rail is movably coupled with the shiplift platform and is movable between at least two positions. The at least two positions include a first rail position in which the transition rail extends across a gap between the shipyard and the shiplift platform and is engaged with the shipyard and in which the transition rail is positioned between the shipyard rail and the platform rail. The at least two positions include a second rail position in which the transition rail is disengaged from the shipyard.

An embodiment of the present disclosure includes a method of transferring a ship between a shipyard and a shiplift platform. The method includes positioning a shiplift platform adjacent a shipyard. The shipyard has a shipyard rail thereon and the shiplift platform has a platform rail thereon. A gap is between the shipyard and the shiplift platform such that the shipyard rail and the shiplift platform are spaced apart. The method includes positioning a transition rail on the shiplift platform into a first rail position such that the transition rail extends across the gap and is engaged with the shipyard and such that the transition rail is positioned between and aligned with the shipyard rail and the platform rail. The method includes moving a ship supported on a transfer cradle between the shiplift platform and the shipyard. The moving the ship includes moving the transfer cradle with a bogie having a rail wheel. During the moving, the rail wheel rolls along each of the shipyard rail, the transition rail, and the platform rail. After moving the ship, the method includes moving the transition rail into a second rail position such that the transition rail is disengaged from the shipyard and is clear of the gap.

An embodiment of the present disclosure includes a shiplift transfer system. The system includes a first end block having a rail slot, a pin slot, and a concave contact surface. The system includes a transition rail having a trunnion pin and a convex contact surface. The transition rail is coupled within the rail slot and the trunnion pin is positioned within the pin slot. The convex contact surface is movably engaged with the concave contact surface, and a clearance gap is maintained between the trunnion pin and walls of the pin slot. The transition rail is pivotable about the trunnion pin between at least two positions.

BRIEF DESCRIPTION OF THE DRAWINGS

So that the manner in which the features and advantages of the systems and methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

DETAILED DESCRIPTION

Embodiments of the present disclosure include systems and methods for facilitating the transfer of ships between a shiplift platform and a shipyard. The systems and methods disclosed herein are configured to accommodate for the occurrence of misalignment and/or relative movement (e.g., due to load deflections and/or thermal expansion) between the shiplift platform and shipyard (and associated rails thereon) such that a ship can be moved between a shiplift platform and shipyard when the shiplift platform and shipyard are moving relative to one another and/or are misaligned. In certain embodiments, ships are moved between the shiplift platform and shipyard on rails. In such embodiments, the systems and methods are configured to accommodate for the occurrence of misalignment and/or relative movement of the rails on the shiplift platform and shipyard.

Shipyard and Shiplift

Figure 1:
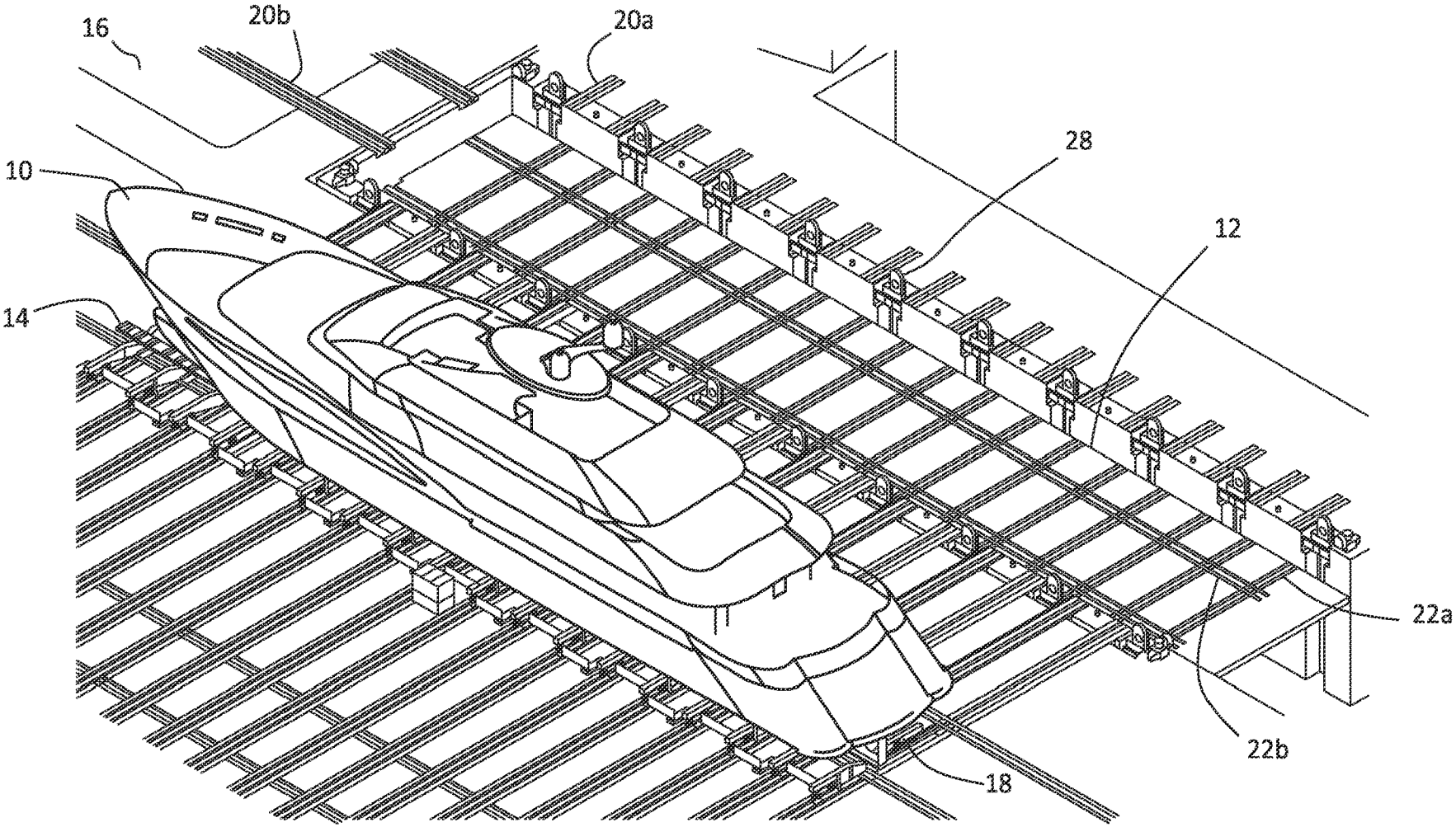
FIG. 1 depicts a shiplift transfer system for moving a ship onto and off of a shiplift platform.

With reference to FIG. 1, shiplift transfer involves moving a ship 10 onto and/or off of a shiplift platform 12 via a transfer carriage 14. When docking, the ship 10 is raised out of the water by the shiplift platform 12 for movement onto the shipyard 16 using hoists 28. The ship 10 is positioned on the transfer carriage 14, which is then moved off of the shiplift platform 12 and onto the shipyard 16. The movement of the transfer carriage 14 onto and within the shipyard 16 is driven by hydraulic bogies 18. The transfer carriage 14 and/or the hydraulic bogies 18 move within the shipyard 16 along rails within the shipyard 16, which can include lateral shipyard rails 20*a* and longitudinal shipyard rails 20*b*. The shiplift platform 12 also has rails, including lateral platform rails 22*a* and longitudinal platform rails 22*b*. The transfer carriage 14 and/or the hydraulic bogies 18 move along the shiplift platform 12 and shipyard 16 on the rails 22*a*, 22*b*, 20*a*, and 20*b*. U.S. Pat. No. 10,577,061 includes disclosure relevant to shiplift platforms and the operation thereof. In some embodiments, the shiplift platform disclosed herein is the same or similar to that disclosed in U.S. Pat. No. 10,577,061. U.S. Patent Publication No. 2019/0263488 includes disclosure relevant to bogie transfer systems and the operation thereof. In some embodiments, the bogies disclosed herein are the same or similar to those disclosed in U.S. Patent Publication No. 2019/0263488. However, the systems and methods disclosed herein are not limited to being used with a particular shiplift platform or bogie transfer system.

Transition Rail and Wheel Engagement

Some embodiments include a transition rail for spanning a gap between a shiplift platform and a shipyard, and methods of making and using the same. The transition rail can be coupled with a shipyard, and can be selectively engaged with a shiplift platform. For example, the transition rail can be pivotably coupled with the shipyard such that the transition rail is pivotable between a position where the transition rail is engaged with a shiplift platform and a position where the transition rail is disengaged with the shiplift platform. Alternatively, the transition rail can be coupled with the shiplift platform, and can be selectively engaged with the shipyard.

Figure 2:
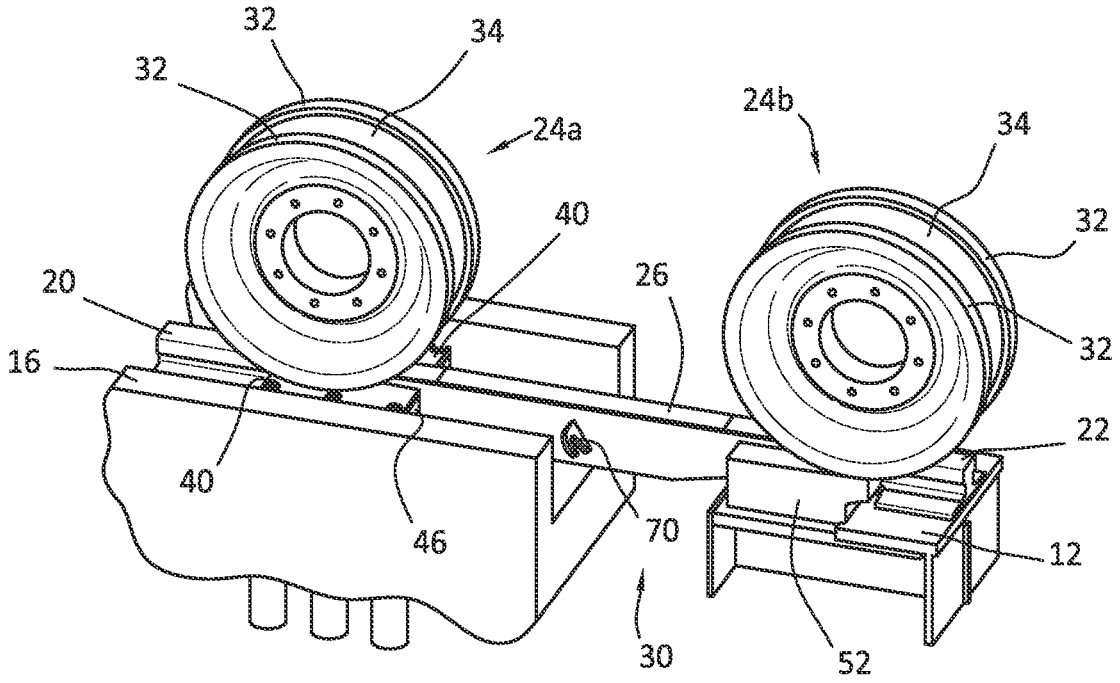
FIG. 2 depicts bogie wheels crossing over a transition rail.
Figure 3:
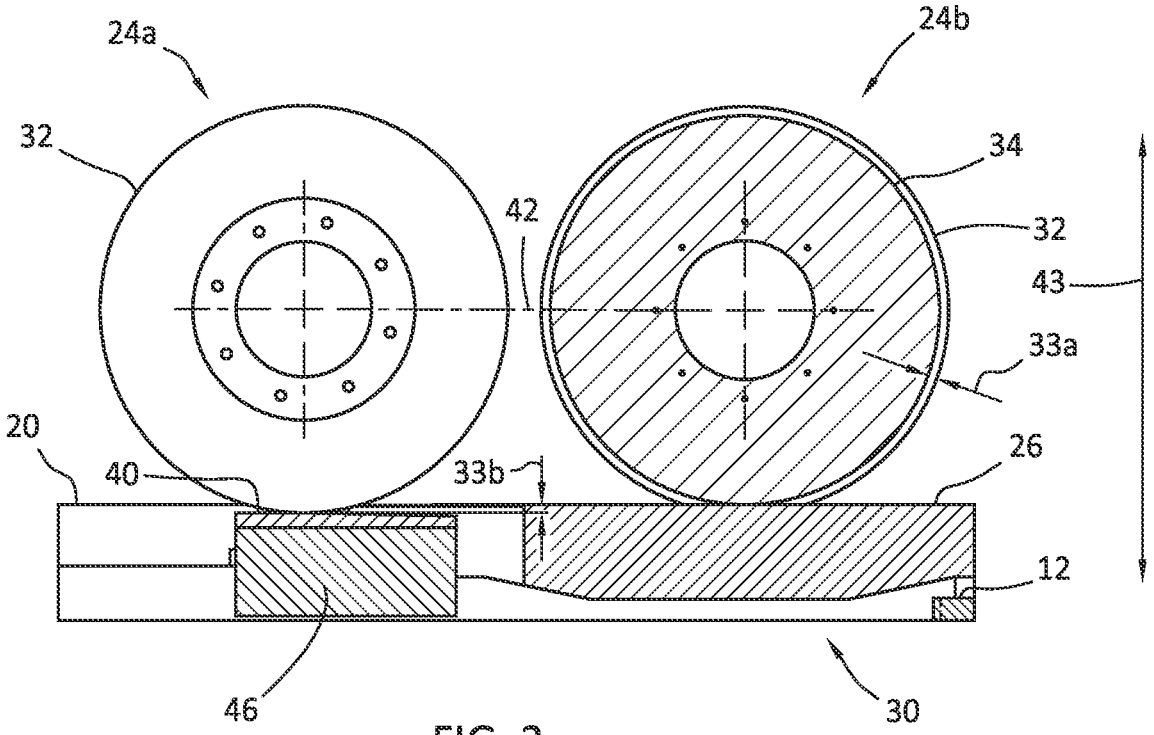
FIG. 3 is a cross-sectional view of bogie wheels, including tread and a rim, crossing over a transition rail.

With reference to FIGS. 2 and 3, an exemplary transition rail 26 and associated components are depicted spanning a gap 30 between a shipyard 16 and shiplift platform 12. In FIGS. 2 and 3, only a portion of the shipyard 16 and shiplift platform 12 are shown.

Gap 30 is present between the shipyard 16 and shiplift platform 12, such that shipyard rail 20 and platform rail 22 are spaced apart from one another. The transition rail 26 is positioned to span the gap 30 to accommodate movement of a ship across the gap 30 between the shipyard 16 and shiplift platform 12. In particular, transition rail 26 is fixedly attached with the end block 46 of the shipyard 16 and is selectively engageable with the end block 52 of the shiplift platform 12. Transition rail 26 includes pull hook 70. Pull hook 70 can be used to move the transition rail 26 between engagement and disengagement with the shiplift platform 12, as described in more detail below. The transition rail 26 is positioned to facilitate rail wheels that are transitioning from moving along rail 20 to moving along rail 22, or are transitioning from moving along rail 22 to moving along rail 20. The transition rail 26 is positioned to extend between the rails 20 and 22, such that the transition rail 26 bridges the gap 30 between the shipyard 16 and the shiplift platform 12 and between the respective rails 20 and 22.

Wheels 24*a* and 24*b* are depicted engaged with the transition rail 26. The wheels 24*a* and 24*b* are depicted in isolation of other structure; however, the wheels 24*a* and 24*b* may be wheels of a transfer carriage, bogie or other wheeled device that is moving along rails between the shipyard 16 and shiplift platform 12.

In the embodiment depicted in FIGS. 2 and 3, the transition rail 26 is configured to accommodate wheels 24*a* and 24*b* that have two rims 32 and wheel tread 34. The wheels 24*a* and 24*b* have a first diameter at the rims 32 and a second diameter at the treads 34, and the first diameter is greater than the second diameter, as illustrated by diameter differential 33*a*. For example, the wheels 24*a* and 24*b* may have a diameter at the rims 32 of 25 mm or a radius of 12.5 mm, and a diameter at the tread 34 of less than 25 mm or a radius less than 12.5 mm. The arrangement of variations in diameter of the wheels 24*a* and 24*b* provides for the ability of the tread 34 of the wheels 24*a* and 24*b* to disengage from contact with one of rails 20, 22, or 26 while the wheel rims 32 (e.g., flanges) engage with the transitional structures (e.g., the end blocks 46 or 52) between the rail discontinuities (i.e., between adjacent rails). As shown in FIG. 3, tread 34 of wheel 24*b* is engaged with transition rail 26, and rims 32 of wheel 24*a* are engaged with retainer plates 40. As shown by elevation line 42 of FIG. 3, the wheels 24*a* and 24*b* may be maintained at the same elevation while moving from one rail to another across the gap 30.

The end blocks 46 and 52 are positioned at a first elevation that is lower than the elevation of the rails (20, 22, and 26). The elevation differential 33*b* in elevation between the end blocks 46 and 52 and the rails (20, 22, and 26) is equivalent to the diameter differential 33*a* between the first and second diameters of the wheels 24*a* and 24*b*, such that the rail wheels are maintained at the same or substantially the same elevation during and after transitioning from movement of the treads along the rails to movement of the rims along the end blocks 46 and 52. With reference to FIG. 3, elevation refers to a position along elevation line 43 (e.g., elevation 42).

Figure 4:
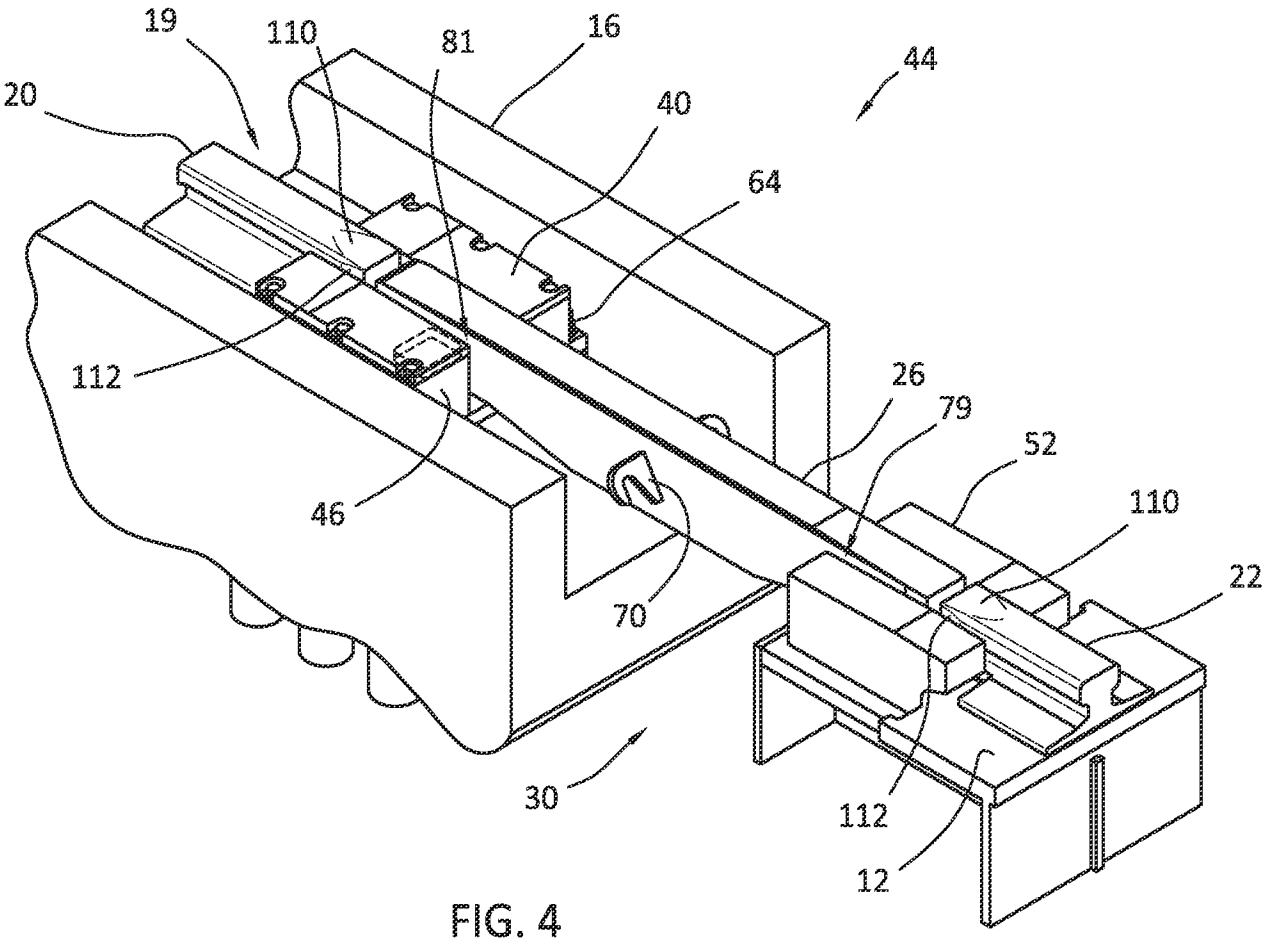
FIG. 4 depicts a transition rail spanning a gap between a shipyard and a shiplift platform.

FIG. 4 depicts various components of an embodiment of a transition rail system 44. Shipyard 16 includes shipyard rail 20 coupled therewith. For example, shipyard rail 20 can be affixed to concrete of the shipyard 16. Shiplift platform 12 includes platform rail 22 coupled therewith. Each of rails 20 and 22 include beveled top surfaces 110 and beveled side surfaces 112. As described in more detail below, the beveled top surfaces 110 and beveled side surfaces 112 can provide the rails with a tapered end that facilitates the movement of rail wheels between rails 20, 22, and 26 by accommodating misalignments between the rails 20, 22, and 26.

Transition rail system 44 includes end block 46. End block 46 and rail 20 are positioned within a trough 19 of shipyard 16. End block 46 is coupled with the shipyard 16 via leveling studs 64 (e.g., threaded rods or bolds). End block 46 includes or defines a rail slot 81. A portion of rail 20 extends into rail slot 81.

Transition rail 26 is coupled with end block 46 and partially positioned within rail slot 81. Retainer plates 40 are coupled with end block 46 and retain the transition rail 26 in engagement with the end block 46. End block 46 also includes rail cup 88 (now shown in FIG. 4) positioned beneath the retainer plates 40. The rail cup 88 is described in more detail below.

In FIG. 4, the transition rail 26 is positioned to span the gap 30 between the shipyard 16 and the shiplift platform 12. Shiplift platform 12 includes end block 52 with rail slot 79. Rail 22 partially extends into rail slot 79. Transition rail 26 extends from end block 46, across gap 30, and is engaged within rail slot 79 of end block 52. The rail slots 81 and 79 of the end blocks 46 and 52 define the location where the transition rail 26 is positioned for alignment between the transition rail 26 and the rails 20 and 22. With the rails aligned, a rail wheel can roll from one of the rails onto the adjacent rail. When the transition rail 26 is in the second rail position the transition rail is not aligned with both of the rails 20 and 22.

Foundation Interface

FIGS. 5A-6B depict structures of the transition rail system that interface alignment of the rail 20 of the shipyard 16 with the transition rail 26 (not shown in FIGS. 5A-6B). The foundation interface 60 includes a base plate 62 having leveling rods 64 extending therethrough. The leveling rods 64 are operable for leveling of the base plate 62; thereby, leveling the transition rail (not shown) when the transition rail is positioned on the foundation interface 60. For example, the leveling rods 64 (or bolts threaded thereto) can be threaded clockwise and/or counterclockwise to adjust a position and level of the base plate 62 coupled therewith. Therefore, the leveling rods 64 can be used to position the transition rail at the same or similar elevation as the rail 20.

Figure 5A:
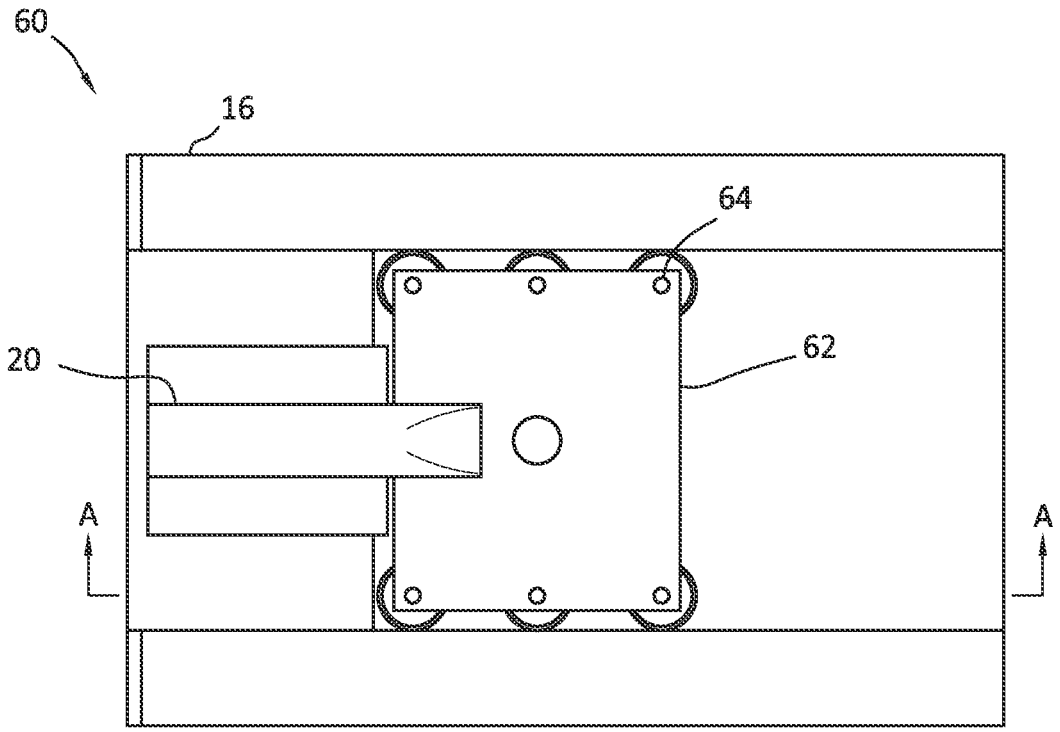
FIG. 5A is a top view of a foundation interface for interfacing the transition rail with the foundation of the shipyard.
Figure 5B:
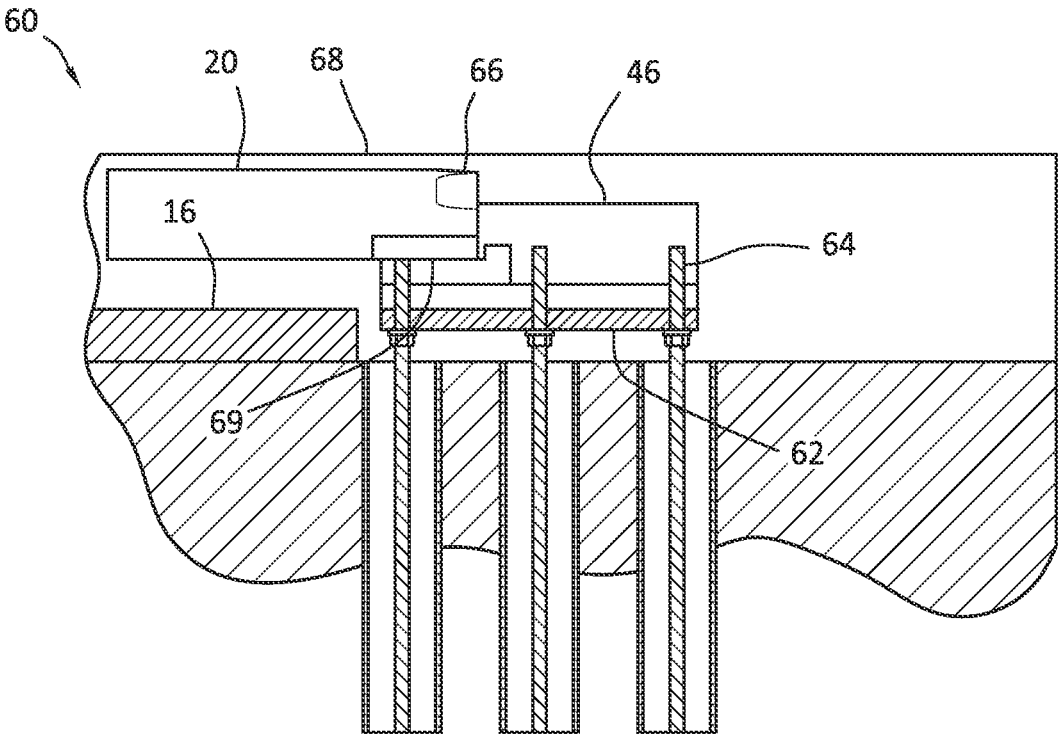
FIG. 5B is a cross-sectional view of FIG. 5A along line A-A.
Figure 6A:
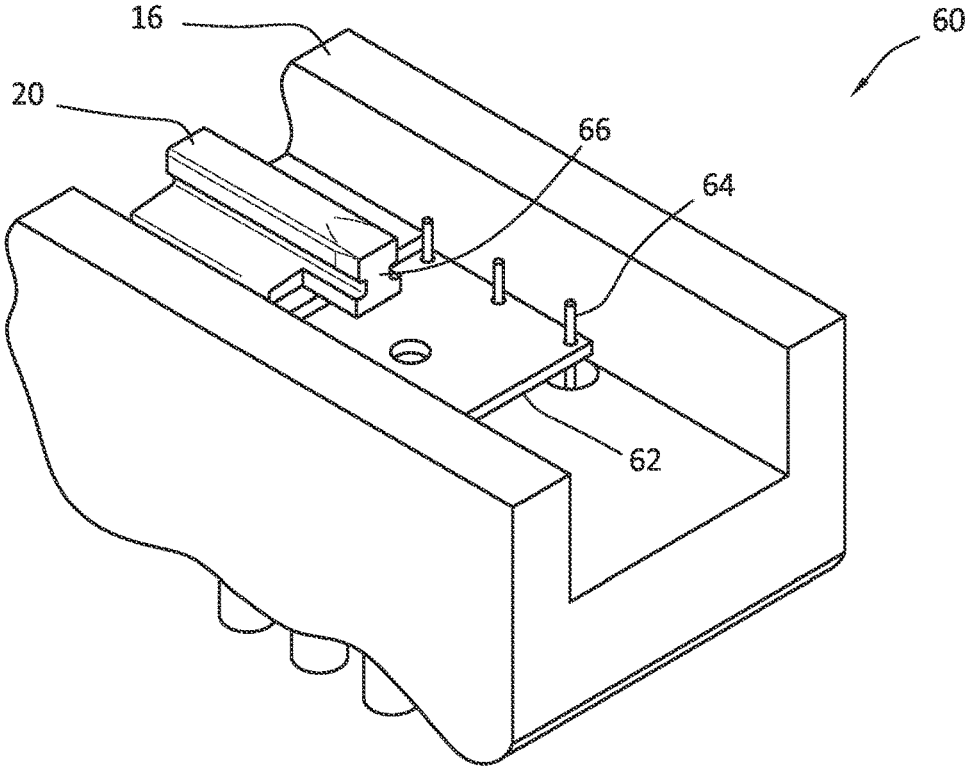
FIG. 6A is a perspective view of the foundation interface.
Figure 6B:
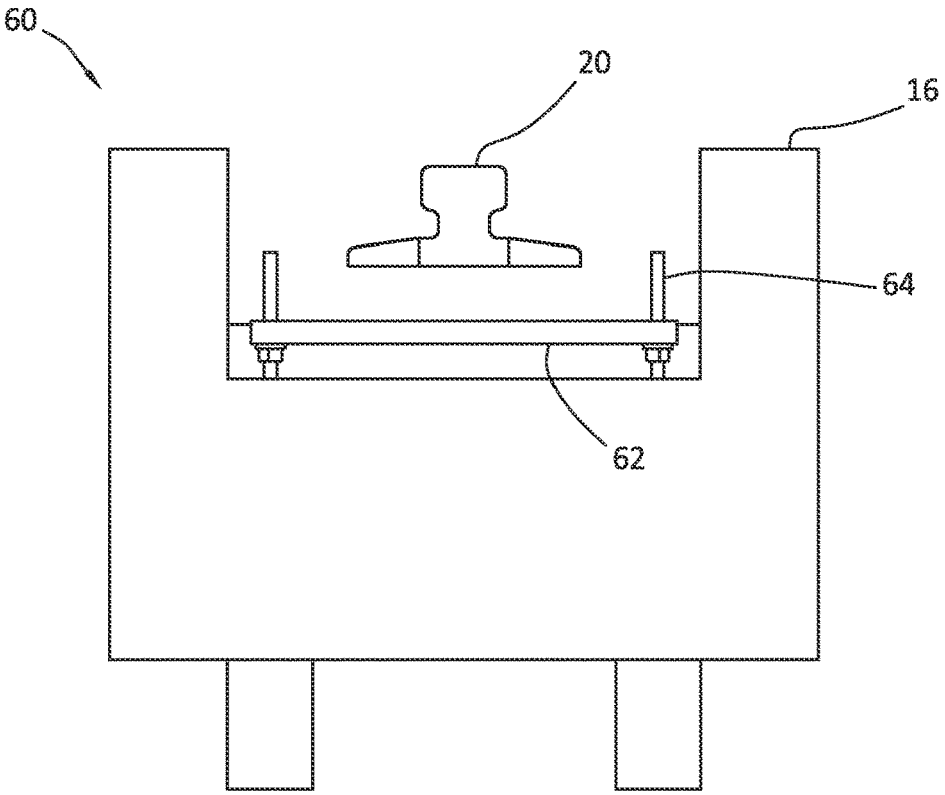
FIG. 6B is an end view of the foundation interface of FIG. 6A.

Rail 20 has rail end, overhang end 66, that overhangs (i.e., extends over) the base plate 62. When end block 46 is installed, end block 46 is positioned to support overhang end 66, such that the bottom surface 69 of rail 20 at the overhang end 66 is in contact with the end block 46. In some embodiments, with the end block 46 in place, the base plate 62 is grouted into place on the shipyard 16 to maintain the position of the base plate 62. Also shown in FIG. 5B is the yard elevation level 68.

Transition Rail Movement

The transition rail disclosed herein can be rotated (e.g., manually rotated) or otherwise moved between at least two different positions. For example, with reference to FIG. 7, transition rail 26*a* is shown in a first position where the transition rail 26*a* bridges the gap 30 between rail 20 of the shipyard 16 and rail 22 of the shiplift platform 12. In the first position, the transition rail 26*a* extends from end block 46 to engagement with end block 52. In the first position, the transition rail 26*a* is positioned to facilitate the movement of ships between the shipyard 16 and the shiplift platform 12.

When a ship is entering or exiting a dock at the shipyard 16, the transition rail disclosed herein can be moved into a section position that is clear of the ship where the transition rail is not protruding into a space that would pose a risk of puncturing a hull of the ship. For example, transition rail 26*b* is depicted in a second position where the transition rails 26*b* is positioned further away from the space where the gap 30 is formed, such that the transition rail 26*b* poses a reduced risk of engaging with the ship as the ship is entering the dock over the shiplift platform 12. Transition rail 26*b* is positioned upwards relative to the position of transition rail 26*a*, and a clearance gap 71 is present between transition rail 26*b* and shipyard rail 20.

One skilled in the art would understand that transition rails 26*a* and 26*b* are not simultaneously present, but represent the same transition rail in two different positions. To move the transition rail from the first position to the second position, the pull hook 70 can be pulled upon to lift the transition rail upwards. As the transition rail is lifted upwards, the position of the transition rail pivots about trunnion pin 72, which is engaged with the end block 46 between base plate 62 and retainer plates 40. One skilled in the art would understand that the movement of the transition rail from the first and second positions is not limited to the particular mechanisms and methods illustrated in FIG. 7. Also, one skilled in the art would understand that the transition rail is not limited to being moved between only two positions, and may move between other positions. Furthermore, one skilled in the art would understand that movement of the transition rail is not limited to manual actuation (e.g., by pulling on the pull hook 70), and may be automated, such as by using hydraulic actuators. The transition rail disclosed herein includes a flat surface 67 that, when in the second position, is in contact with a shoulder of the end block 46. The transition rail disclosed herein includes a cylindrical, convex contact surface 84 that, when in the first position, is in contact with the concave contact surface of the cup, as described in more detail below.

Figure 8:
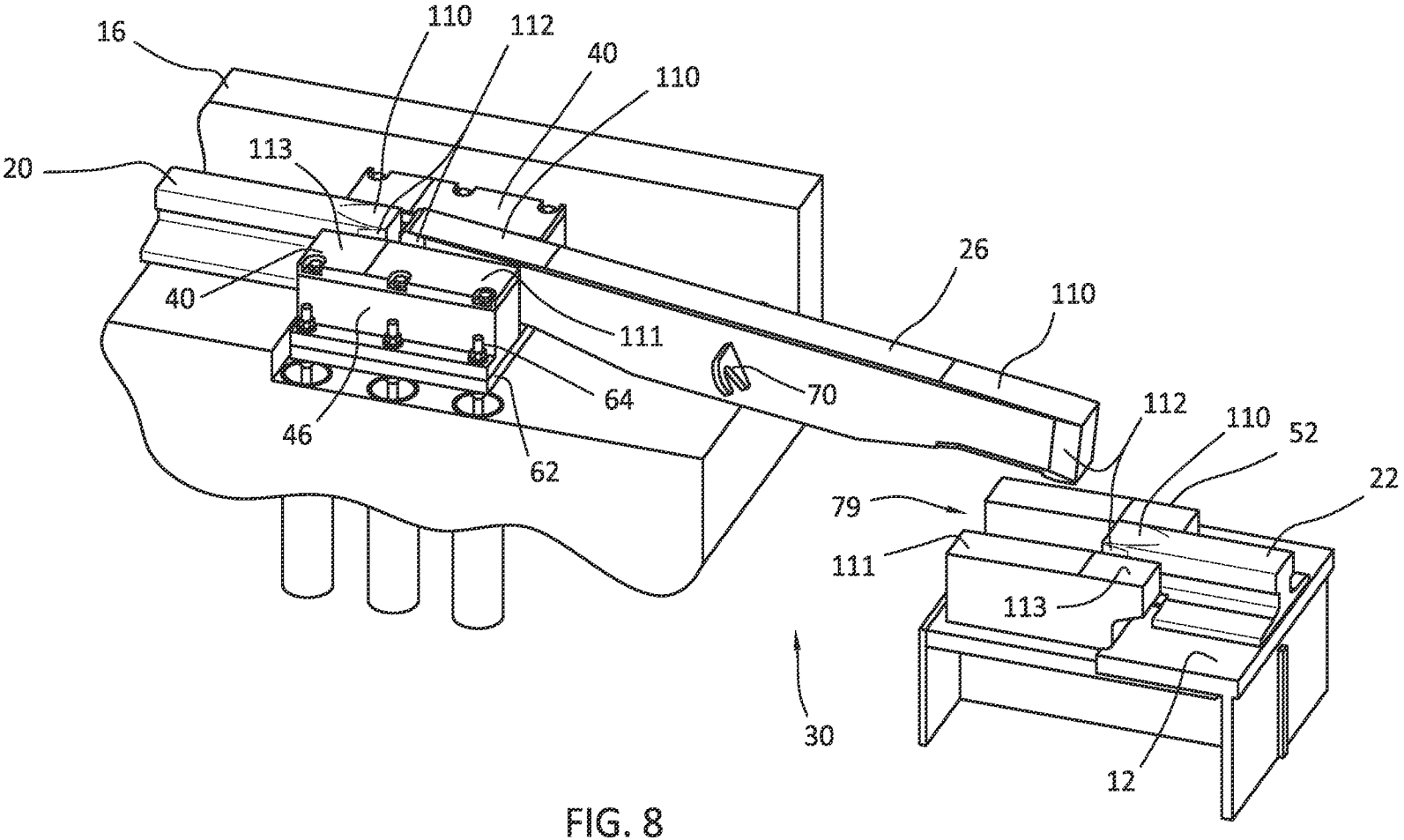
FIG. 8 depicts a transition rail in an overhanging position prior to engagement with a shiplift platform.
Figure 9:
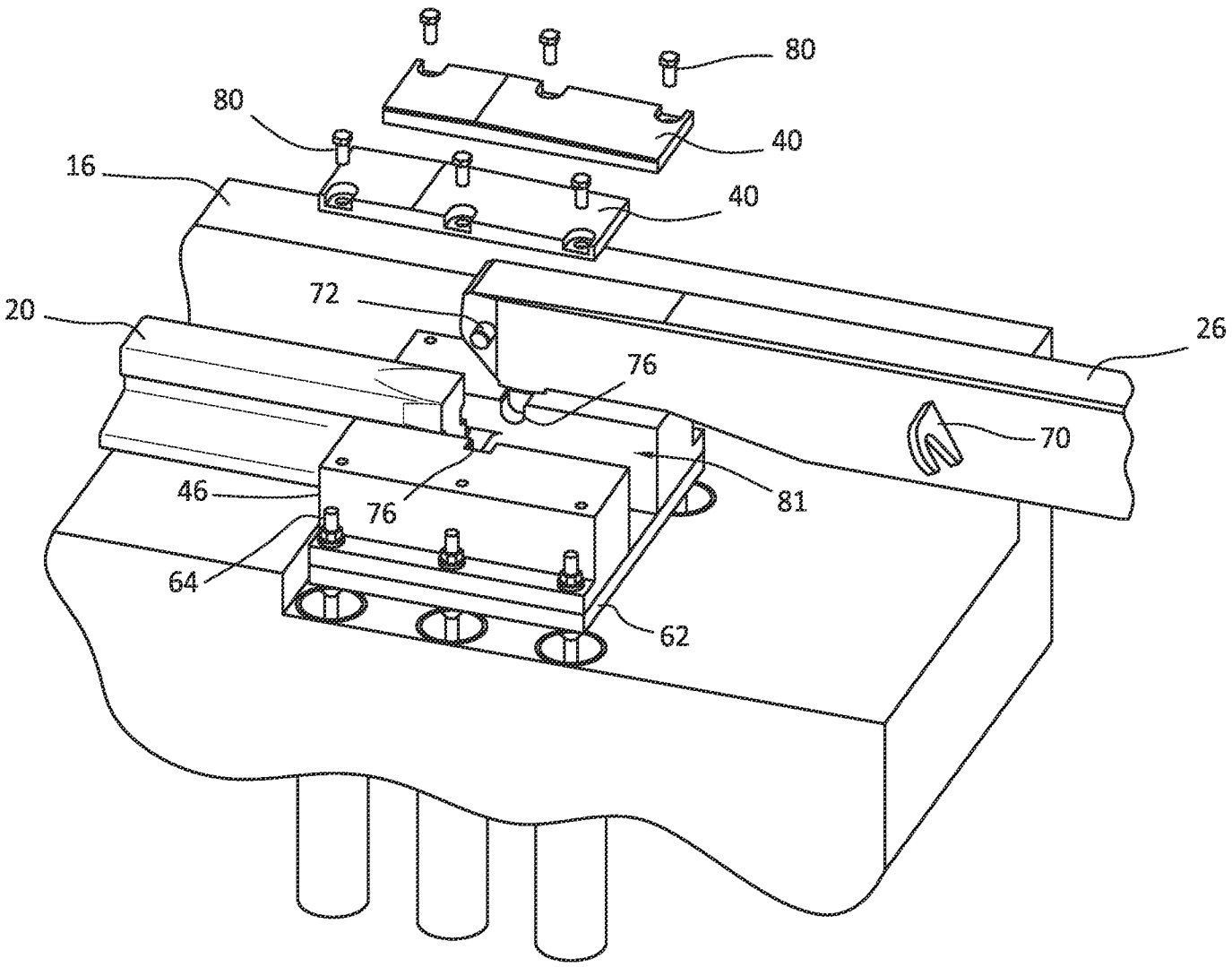
FIG. 9 depicts retainer plates for coupling a transition rail with the shipyard.

Transition Rail Engagement and Alignment with the Shiplift Platform and Shipyard With reference to FIGS. 8 and 9, the methods disclosed herein can include raising the shiplift platform 12 into a full-up position. FIG. 8 depicts the shiplift platform 12 being raised and nearing the full-up position such that the end block 52 is about to engage with the transition rail 26 that is hanging over the gap 30. FIG. 9 is an exploded view of the connection between the transition rail 26 and the shipyard 16. During receipt of a ship (not shown) at the shipyard 16, the shiplift platform 12 is typically positioned within the water, below the elevation of the shipyard 16, such that the ship is floated into position adjacent the shipyard 16 and above the shiplift platform 12. With the ship in position above the shiplift platform 12, the shiplift platform 12 is then raised to a position such that the shiplift platform 12 is at the same or substantially same elevation as the elevation of the shipyard 16. Prior to, during, or after raising the shiplift platform 12, the transition rail 26 is moved (e.g., rotated and/or lowered) into a position to engage within the rail slot 79 of the end block 52 on the shiplift platform 12, such that the transition rail 26 overhangs and spans the gap 30. In some embodiments, the transition rail 26 is moved to the position to engage within the rail slot 79 prior to or during raising the shiplift platform 12, such that the transition rail is positioned to engage the shiplift platform 12 as the shiplift platform 12 is being raised upwards (e.g., via the hoists 28 shown in FIG. 1). In other embodiments, the transition rail 26 is moved to the position to engage within the rail slot 79 after raising the shiplift platform 12, such that the shiplift platform 12 is positioned to receive and engage with the transition rail 26 as the transition rail 26 is moved into position to span the gap 30. Movement of the transition rail 26 can be controlled using the pull hook 70, which can be held while lowering the transition rail 26 into position. As the transition rail 26 is lowered, the position of the transition rail 26 pivots about trunnion pin 72. With the transition rail 26 lowered and the shiplift platform 12 raised, the transition rail 26 engages within the rail slot 79 if the end block 52. The rail slot 79 is sized to receive an end of the transition rail 26 and is positioned and arranged to align the transition rail 26 with the platform rail 22.

As shown in FIG. 9, the transition rail 26 is captured at the trunnion pin 72 by the two retainer plates 40. In addition to retaining the position of the transition rail 26, the retainer plates 40 can serve as a running surface upon which the wheel rims roll upon (e.g., as shown in FIGS. 2 and 3). The retainer plates 40 may be bolted or otherwise affixed onto the end block 46 over the trunnion pin 72, such as via bolts 80. The retainer plates 40 may be selectively decoupled (e.g., unbolted) from the end block 46 such that the transition rail 26 can be removed (e.g., for maintenance and/or replacement if wear occurs) without having to remove the end block 46 or the shipyard rail 20.

The trunnion pins 72 are positioned in pin slots 76 on the end block 46. While only one trunnion pin 72 is shown in FIG. 9, one skilled in the art would understand that another trunnion pin is positioned on the opposite side of the transition rail 26 for engagement with the second pin slot 76. The trunnion pins 72 are pivotably and/or rotatably coupled with the pin slots 76, such that the trunnion pins 72 are rotatable within the pin slots 76 during pivoting movement of the transition rail 26 between positions (e.g., between the two positions shown in FIG. 7).

The end block 46 includes rail slot 81 that is sized and shaped to receive an end of the transition rail 26 and is positioned and arranged to align the transition rail 26 with the shipyard rail 20.

Transition Rail Trunnion Pin

Figure 10:
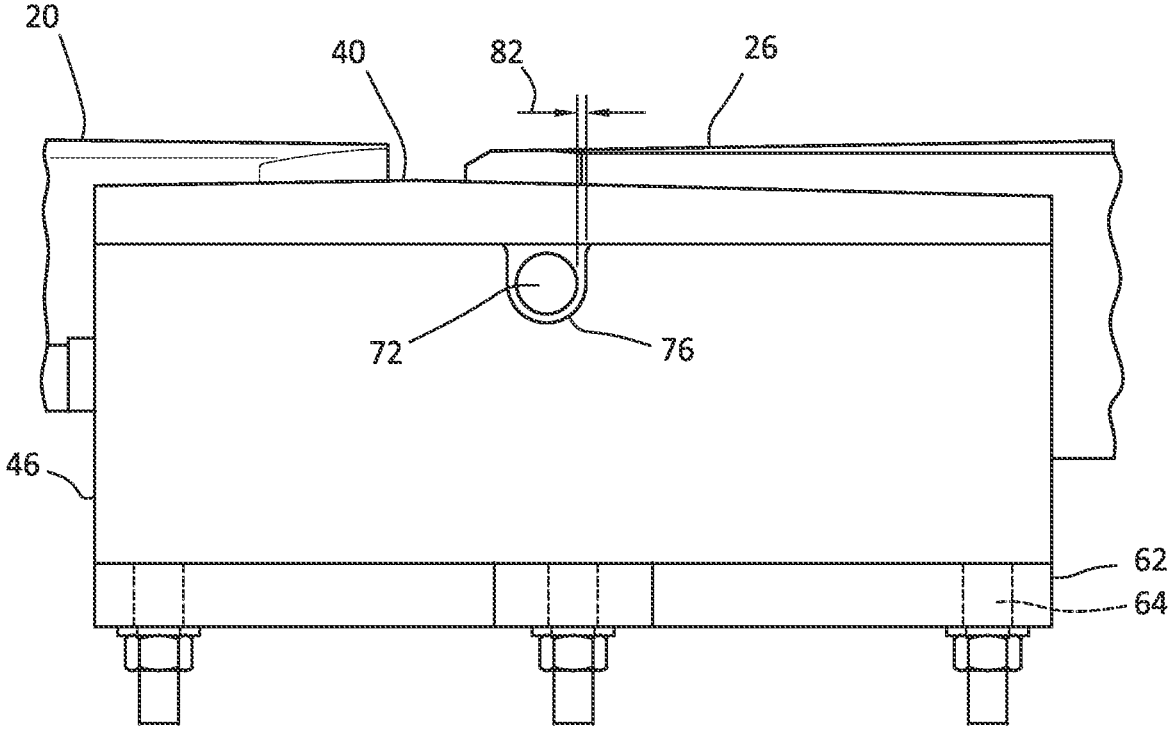
FIG. 10 depicts a trunnion pin positioned in oversized vertical pin slots to accommodate shiplift platform misalignment.

As shown in FIG. 10, the trunnion pins 72 are positioned inside vertical pin slots 76 that are of a size that is sufficient to accommodate misalignment between the shiplift platform and the shipyard. That is, the pin slots 76 allow for movement of the trunnion pins 72 therein and corresponding movement of the transition rail 26, such that at least some misalignment can be present between the shipyard and the shiplift platform, while still providing for a functioning transition rail 26 therebetween.

In some embodiments, the trunnion pins 72 do not touch the inside walls of the vertical pin slots 76 over a range of vertical and horizontal angles that the transition rail 26 moves within. For example, a gap 82 can be present between the trunnion pins 72 and the pin slots 76 during movement and use of the transition rail 26. While the gap 82 may vary in size when under load (e.g., while wheels are moving along the transition rail 26), the gap 82 is maintained both when the transition rails 26 is static and is moving. Thus, the gap 82 is maintained throughout movement of the transition rail 26 in and between multiple positions (e.g., the positions shown in FIG. 7). The gap 82 between the trunnion pins 72 ensures that load is not transferred to the trunnion pins 72 as the shiplift transfer system crosses over the transition rail 26. The gap 82 (also referred to as a clearance gap) can be sized to be sufficient to accommodate misalignment between and relative movement of the shiplift platform and the shipyard.

When the transition rail 26 is in a position where the transition rail 26 is aligned with both the shipyard rails 20 and the platform rails 22 (e.g., transition rail 26*a* of FIG. 7), rail wheels, moving in a first direction, are capable of transitioning from rolling along the shipyard rail 20 to rolling along the transition rail 26 and transitioning from rolling along the transition rail 26 to rolling along the platform rail 20. Also, when the transition rail 26 is in a position where the transition rails 26 is aligned with both the shipyard rails 20 and the platform rails 22, rail wheels, moving in a second direction that is opposite the first direction, are capable of transitioning from rolling along the platform rail 22 to rolling along the transition rail 26 and transitioning from rolling along the transition rail 26 to rolling along the shipyard rail 20.

Figure 7:
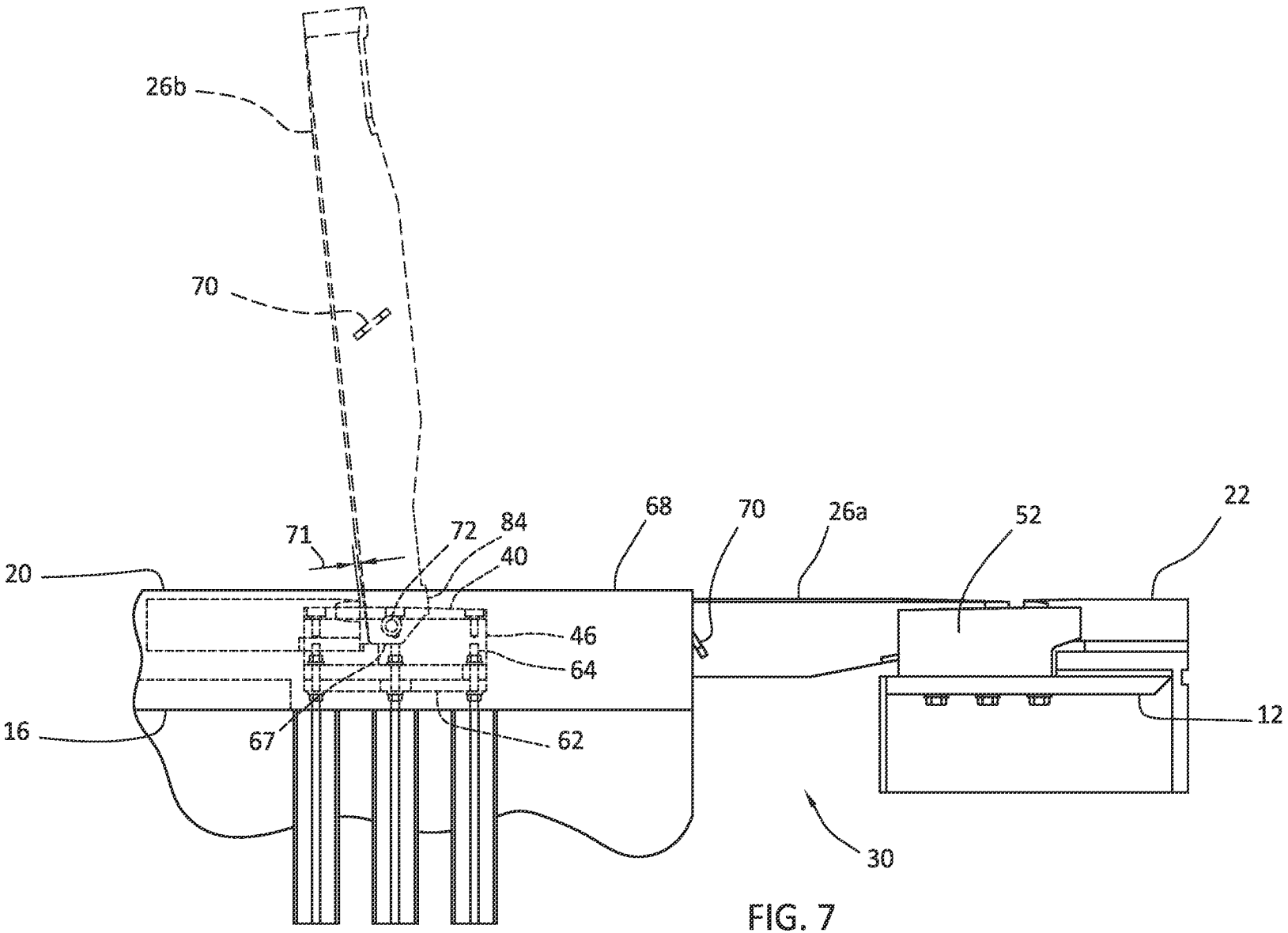
FIG. 7 depicts a transition rail in two different positions.

When the transition rail 26 is in the position of transition rail 26*b* (as shown in FIG. 7), the transition rail 26 is clear of the shiplift platform and clear of the gap. For example, in such a position, the transition rail 26 may be positioned entirely within a perimeter of the shipyard such that the transition rail does not extend past the perimeter of the shipyard.

Transition Rail and Contact Surfaces

Figure 11:
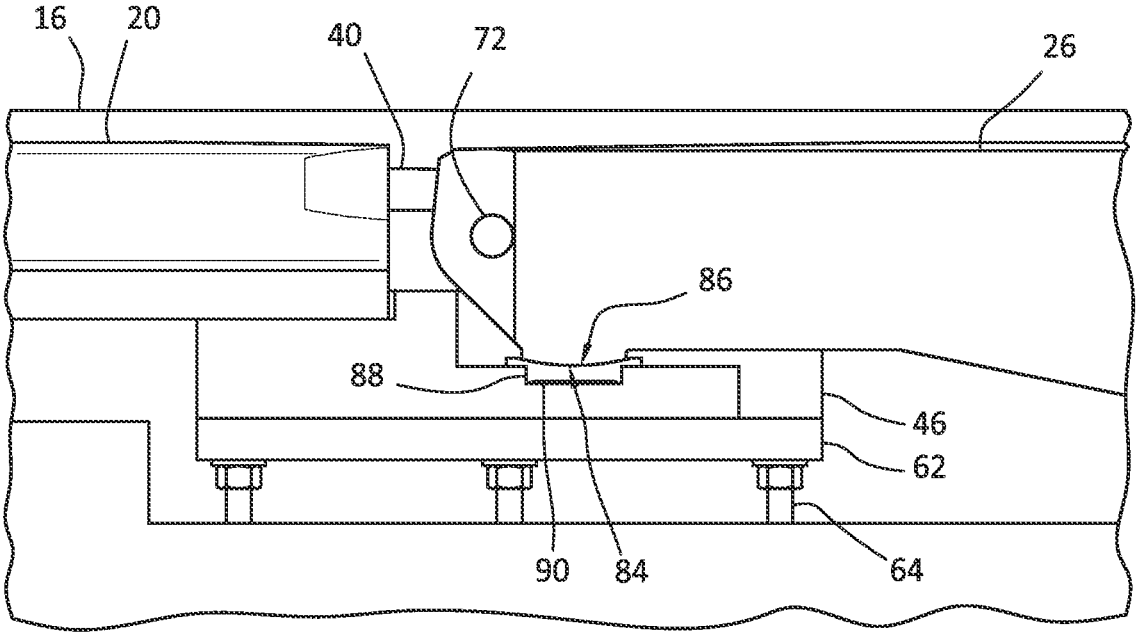
FIG. 11 depicts a bottom of a transition rail positioned inside of a rail cup of a foundation interface.
Figure 12:
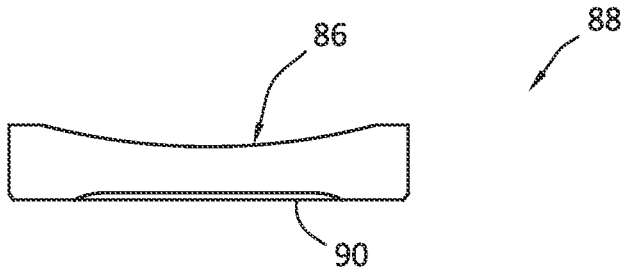
FIG. 12 depicts a rail cup of a foundation interface.
Figure 13:
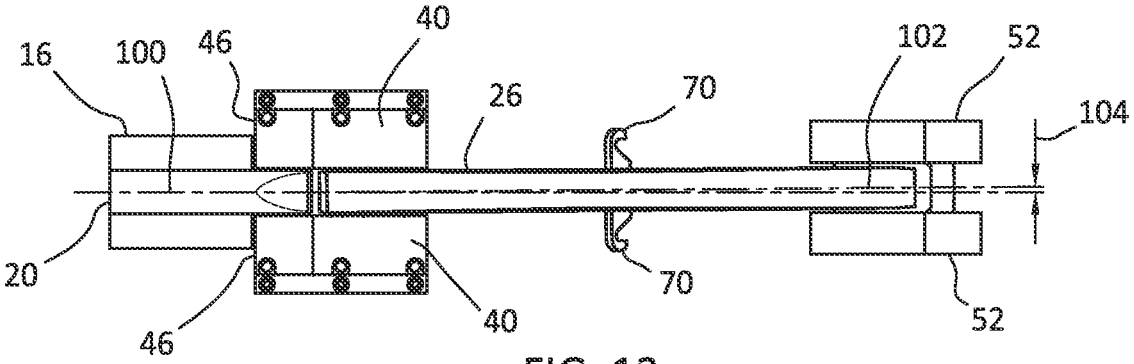
FIG. 13 depicts a platform rail and a shipyard rail, and illustrates a transition rail accommodating the platform rail being offset from the shipyard rail.

With reference to FIGS. 11-13, transition rail 26 includes a curved, convex contact surface 84 (e.g., a cylindrical contact surface) engaged with a concave contact surface 86 (e.g., a cupped surface) on the end block 46. Load on the transition rail 26 is reacted at the convex contact surface 84 on the bottom of the transition rail 26, which is engaged within the concave contact surface 86 of cup 88. In FIG. 11, a portion of the end block 46 is cut away to provide a view of the cup 88 and convex contact surface 84.

The cup 88 includes a flat surface 90 (e.g., a 2 mm flat surface) at a bottom thereof. The cup 88 provides the transition rail 26 with the ability to rotate in the horizontal plane, such as if the shiplift platform 12 position is misaligned. For example, in some embodiments, the transition rail 26 can accommodate the shiplift platform 12 being offset by 10 mm in either direction in the horizontal plane, as illustrated by the misalignment differential 104 between the shipyard rail alignment line 100 and the platform rail alignment line 102 in FIG. 13. The engagement between the concave contact surface 86 and the convex contact surface 84 provides for relative movement between the shiplift platform 12 and the shipyard 16, such as movement due to load deflections, thermal expansion (e.g., of the shiplift platform 12), or other causes of movement. In some embodiments, the convex contact surface 84 slides along the concave contact surface 86 during movement of the transition rail 26 between the positions shown in FIG. 7.

Contoured Rails Surfaces

Figure 14:
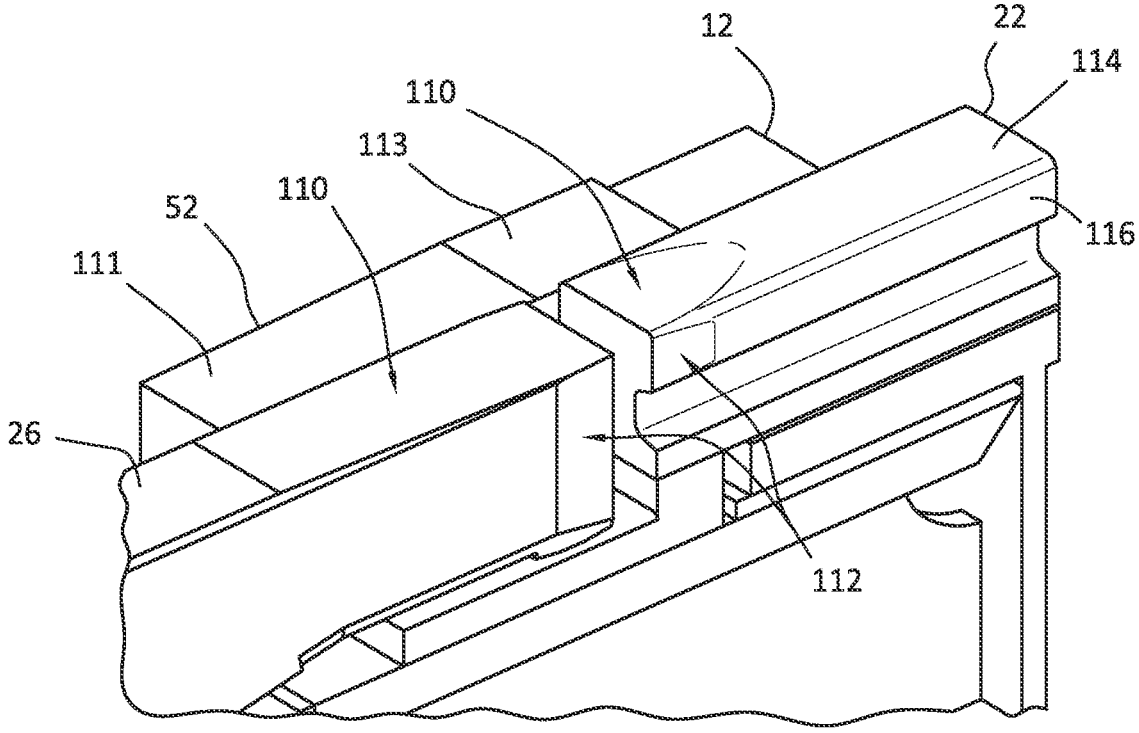
FIG. 14 depicts beveling of rails.

With reference to FIGS. 8 and 14, the surfaces of the ends of the transition rails, shipyard rails, and/or platform rails disclosed herein can be contoured, such as the top surfaces and the side surfaces. The contouring can include concave surfaces on the rails. In some embodiments, the contouring includes beveling. In some embodiments, the contouring includes the ends of the rails being tapered. The contouring provides for a gradual lead-in chamfer that facilitates transition of a wheel moving along one rail to moving along another rail. For example, in the event that a wheel is biased to one side of the rail, is approaching a rail at an angle, or is crossing over a transition between two rails in which the transition rail is at an angle, the contouring facilitates the transition of the wheel. FIG. 14 depicts one exemplary top surface bevel 110 on top rail surface 114 of rail 22. Rail 22 also includes an exemplary side surface bevel 112 on side rail surface 116 of rail 22. Additionally, transition rail 26 includes top surface bevel 110 and side surface bevel 112. In addition to beveling on the rails at the transition, the end blocks can include beveling. As shown in FIG. 14, end block 52 includes beveled surface 111, which slopes downward, relative to surface 113, toward the transition between the rails 22 and 26. The beveling of the surfaces can accommodate for misalignment between the shiplift platform, the shipyard, and/or the transition rail. While shown on the platform rail 22 in FIG. 14, the same or similar bevels may be present on the transition rail and/or shipyard rail and/or end blocks. Furthermore, while shown as bevels, this feature is not limited to being in the form of a bevel and may be or include other surface features, contours, tapers, and/or concavities that facilitate transition of a wheel from one rail to another rail.

With reference to FIG. 8, yard rail 20 includes top and side bevels 110 and 112, shiplift rail 22 includes top and side bevels 110 and 112, and transition rail 26 includes top and side bevels 110 and 112. Furthermore, end block 46 includes top beveled surfaces 111 and end block 52 includes top beveled surfaces 111. While only top beveled surfaces on the end blocks 46 and 52 are referenced, one skilled in the art would understand that the end blocks can include side beveled surfaces as well. The beveled surfaces 110, 112, and 111 are positioned on the rails and end blocks at the transition points (i.e., at positions where a wheel moving along the rails will transition from moving along one rail to another rail) such that the bevels facilitate the transition of movement of the wheel. The interaction of the beveled surfaces, at the transitions, with the rail wheels provides for a smooth transition of rail wheels, even where the shiplift platform 12 is moving relative to the shipyard 16 and where the shiplift platform 12 is misaligned relative to the shipyard 16. In FIG. 8, at least two transition points are shown, including a transition between the yard rail 20 and the transition rail 26 at end block 46, and a transition between the shiplift rail 22 and the transition rail 26 at end block 52.

In some embodiments, the surface bevels on the rails have a slope (e.g., a 1° slope) that is configured to provide for a gradual transitional event or rail transition. As used herein, a "transitional even" or a "rail transition" is an action and/or movement of a wheel on rails when the wheel is moving from rolling on one rail to rolling on another rail. By providing a gradual transitional event, smooth operation of the shiplift transfer system is facilitated. The surface bevels facilitate avoidance of engagement between curbs and/or corners of the rails with a wheel, which could result in banging noises, vibrations, and/or sticking or jamming of a wheel on a rail or between two rails. Some embodiments of the methods disclosed herein include shaping the surfaces of the rails and/or end blocks to provide the surface contouring (beveling, tapering) disclosed herein.

In some embodiments, the top surface bevels 110 are designed to accommodate the variations in vertical angles of the transition rail 26, such as angles 1° upwards or 1° downwards relative to the top surface 114 of the rail 22. Such vertical angle variations may occur, for example, if the shiplift platform rail 22 is positioned higher (e.g., due to raising the shiplift platform 12 too much) or lower (e.g., due to deflection in the shiplift platform under the load of the ship) than the shipyard rail. Clearance is provided between wheel running surfaces and sharp edges at the transition rail 26 and associated structures, such that, within a range of motion, a wheel will transfer to contact with beveled surfaces without contacting corners or sharp edges. The flange running surface of the rims of the wheels may be, for example, 12.5 mm below the level of the tread running surface of the tread of the wheels. The transition rail disclosed herein may be designed to ensure that, within ranges of angles, the transition point is not outboard of the pivot point of the transition rail, which could cause the transition rail to flip upward.

The present disclosure includes systems and methods configured to accommodate the movement of a ship between a shiplift platform to a shipyard. The systems and methods are configured to accommodate misalignment between and relative movement of the shiplift platform and associated rails, shipyard and associated rails, and transition rails therebetween. As described in more detail herein, some embodiments of the present disclosure include: (1) transition rails having trunnion pins that are engaged within pin slots in which a clearance gap is maintained between the pins and walls of the pin slots such that load on the transition rails is not reacted at the pins; (2) selectively removable retainer plates positioned over the engagement between the transition rails and the shipyard to provide for access to the transition rails for maintenance and/or replacement; (3) concave cup surfaces on the shipyard engaged with convex cylindrical surfaces on the transition rails to accommodate relative movement between the shipyard and shiplift platform (e.g., due to load deflections and/or thermal expansion); (4) beveled and/or tapered surfaces on the rails to accommodate for misalignment between adjacent rails; or (5) combinations thereof.

While described in relation to transitions between rails on a shipyard and rails on a shiplift platform, the systems and method disclosed herein may be used in other shipyard applications as well as in non-shipyards applications. While the transition rails disclosed herein are described as being coupled to the shipyard and pivotable relative to the shipyard to be clear of the shiplift platform, in other embodiments the transition rails are coupled to the shiplift platform and pivotable relative to the shiplift platform.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A shiplift transfer system, the system comprising:

a shipyard, the shipyard having a shipyard rail thereon;

a shiplift platform positioned adjacent the shipyard, the shiplift platform having a platform rail thereon;

a transition rail, wherein the transition rail is movably coupled with the shipyard or is movably coupled with the shiplift platform, wherein the transition rail is movable between at least two positions;

wherein the at least two positions include a first rail position wherein the transition rail extends across a gap between the shipyard and the shiplift platform and is engaged with the shipyard and the shiplift platform and wherein the transition rail is positioned between the shipyard rail and the platform rail; and wherein the at least two positions include a second rail position wherein the transition rail is disengaged from one of the shipyard and the shiplift platform.

2. The system of claim 1, further comprising a first end block coupled with one of the shipyard and the shiplift platform, wherein the transition rail is movably coupled with the first end block.

3. The system of claim 2, further comprising:

at least one pin slot in the first end block; and at least one trunnion pin on the transition rail, wherein the at least one trunnion pin is positioned within the at least one pin slot, and wherein the transition rail is movable between the first and second positions by pivoting about the at least one trunnion pin within the at least one pin slot.

4. The system of claim 3, further comprising a clearance gap between the at least one trunnion pin and the at least one pin slot.

5. The system of claim 4, wherein the clearance gap is sufficient to accommodate misalignment between the shiplift platform and the shipyard.

6. The system of claim 3, further comprising at least one retainer plate coupled with the first end block, wherein the at least one trunnion pin is positioned between the at least one pin slot and the at least one retainer plate such that the at least one retainer plate retains the at least one trunnion pin within the at least one pin slot.

7. The system of claim 6, wherein the at least one retainer plate is selectively attachable to and detachable from the first end block.

8. The system of claim 6, wherein the at least one retainer plate comprises a top surface, and wherein the top surface is positioned adjacent the transition rail.

9. The system of claim 8, wherein a top surface of the transition rail is positioned at a first elevation, wherein the top surface of the at least one retainer plate is positioned at a second elevation, and wherein the second elevation is lower than the first elevation.

10. The system of claim 6, further comprising a base plate coupled with the shipyard via leveling rods, wherein the first end block is positioned between the base plate and the at least one retainer plate.

11. The system of claim 10, wherein a first end of the shipyard rail overhangs the base plate, and wherein the first end block is positioned to support the first end of the shipyard rail.

12. The system of claim 2, wherein the first end block comprises a concave contact surface thereon, wherein the transition rail comprises a convex contact surface thereon, and wherein the convex contact surface is movably engaged with the concave contact surface.

13. The system of claim 12, wherein load on the transition rail is reacted at the convex contact surface.

14. The system of claim 12, wherein engagement between the convex contact surface and the concave contact surface accommodates movement of the transition rail between the first and second rail positions.

15. The system of claim 14, wherein engagement between the convex contact surface and the concave contact surface accommodates relative movement between the shiplift platform and the shipyard.

16. The system of claim 2, further comprising a second end block on the shipyard or the shiplift platform, wherein the first and second end blocks each comprise a rail slot, and wherein, in the first rail position, the transition rail is engaged within the rail slots of the first and second end blocks.

17. The system of claim 16, wherein the second end block has a first end adjacent the transition rail, and wherein the first end is tapered or beveled.

18. The system of claim 1, wherein, in the first rail position, a first end of the transition rail is positioned adjacent a first end of the shipyard rail and a second end of the transition rail is positioned adjacent a first end of the platform rail, wherein the first end of the shipyard rail is tapered or beveled, wherein the first end of the platform rail is tapered or beveled, and wherein the first and second ends of the transition rail are tapered or beveled.

19. The system of claim 18, wherein the first end block has a first end positioned adjacent the transition rail, and wherein the first end of the first end block is tapered or beveled.

20. The system of claim 18, wherein the shipyard rail comprises a beveled top surface and a beveled side surface on the first end thereof, wherein the platform rail comprises a beveled top surface and a beveled side surface on the first end thereof, and wherein the transition rail comprises a beveled top surface and a beveled side surface.

21. The system of claim 1, further comprising a pull hook on the transition rail.

22. The system of claim 1, wherein, in the second rail position, the transition rail is positioned inward of a perimeter of the shipyard or inward of a perimeter of the shiplift platform.

23. The system of claim 1, wherein the transition rail is movably coupled with the shiplift platform wherein in the second rail position the transition rail is disengaged from the shipyard.

24. The system of claim 1, wherein the transition rail is movably coupled with the shipyard, and wherein in the second rail position the transition rail is disengaged from the shiplift platform.

25. The system of claim 1, wherein the transition rail is pivotably coupled with the shipyard or the shiplift platform.

26. The system of claim 1, wherein the transition rail rotatably coupled with the shipyard or the shiplift platform.

27. The system of claim 1, wherein the transition rail is movably coupled with the shipyard, and wherein, in the first rail position, the transition rail is movable relative to the shiplift platform to accommodate movement of the shiplift platform.

28. A method of transferring a ship between a shipyard and a shiplift platform, the method comprising:

positioning a shiplift platform adjacent a shipyard, wherein the shipyard has a shipyard rail thereon and the shiplift platform has a platform rail thereon, and wherein a gap is between the shipyard and the shiplift platform such that the shipyard rail and the shiplift platform are spaced apart;

positioning a transition rail into a first rail position such that the transition rail extends across the gap and is engaged with the shipyard and the shiplift platform and such that the transition rail is positioned between and aligned with the shipyard rail and the platform rail; and moving a ship supported on a transfer cradle between the shiplift platform and the shipyard, wherein moving the ship comprises moving the ship on a rail wheel, and wherein during the moving the rail wheel rolls along each of the shipyard rail, the transition rail, and the platform rail; and after moving the ship, moving the transition rail into a second rail position such that the transition rail is disengaged from one of the shipyard and the shiplift platform and is clear of the gap.

29. The method of claim 28, wherein moving the transition rail between the first and second rail positions includes pivoting the transition rail about at least one trunnion pin thereon, wherein the at least one trunnion pin is positioned within at least one pin slot of a first end block coupled with the shipyard.

30. The method of claim 29, further comprising maintaining a clearance gap between the at least one trunnion pin and walls of the at least one pin slot during movement of the transition rail and during movement of the ship.

31. The method of claim 29, further comprising positioning at least one retainer plate on the first end block such that the at least one trunnion pin is positioned between the at least one pin slot and the at least one retainer plate and such that the at least one retainer plate retains the at least one trunnion pin within the at least one pin slot.

32. The method of claim 31, further comprising removing the at least one retainer plate from the first end block to replace or maintain the transition rail, and replacing the at least one retainer plate on the first end block after replacing or maintaining the transition rail.

33. The method of claim 31, wherein the at least one retainer plate comprises a top surface that is positioned adjacent a top surface of the transition rail, wherein the top surface of the transition rail is positioned at a first elevation, wherein the top surface of the at least one retainer plate is positioned at a second elevation, wherein the second elevation is lower than the first elevation, and wherein during the moving of the ship a tread of the wheel engages with the top surface of the transition rail and a rim of the wheel engages with the top surface of the at least one retainer plate.

34. The method of claim 29, wherein the first end block comprises a concave contact surface thereon, wherein the transition rail comprises a convex contact surface thereon, wherein the convex contact surface is movably engaged with the concave contact surface, and wherein, during the moving of the ship, load on the transition rail is reacted at the convex contact surface.

35. The method of claim 34, wherein the convex contact surface and the concave contact surface are movably engaged to accommodate pivoting movement of the transition rail between the first and second rail positions and to accommodate lateral movement of the transition rail.

36. The method of claim 28, further comprising, prior to positioning the transition rails in the first rail position, positioning the transition rails in the second rail position such that the transition rail is clear of one of the shipyard or the shiplift platform; and with the transition rail in the second rail position, lifting the shiplift platform into the position adjacent the shipyard.

37. A shiplift transfer system, the system comprising:

a first end block having a rail slot, a pin slot, and a concave contact surface;

a transition rail having a trunnion pin and a convex contact surface;

wherein the transition rail is coupled within the rail slot and the trunnion pin is positioned within the pin slot;

wherein the convex contact surface is movably engaged with the concave contact surface, and wherein a clearance gap is maintained between the trunnion pin and walls of the pin slot; and wherein the transition rail is pivotable about the trunnion pin between at least two positions.

* * * * *